US008387550B2

(12) United States Patent
Mansour

(10) Patent No.: US 8,387,550 B2
(45) Date of Patent: Mar. 5, 2013

(54) OFFSHORE FLOATING PLATFORM WITH MOTION DAMPER COLUMNS

(76) Inventor: Alaa Mansour, Houston, TX (US)

( * ) Notice: Subject to any disclaimer, the term of this patent is extended or adjusted under 35 U.S.C. 154(b) by 377 days.

(21) Appl. No.: 12/776,374

(22) Filed: May 8, 2010

(65) Prior Publication Data

US 2010/0288178 A1 Nov. 18, 2010

Related U.S. Application Data

(60) Provisional application No. 61/176,903, filed on May 9, 2009.

(51) Int. Cl.
*B63B 35/44* (2006.01)

(52) U.S. Cl. ..... 114/265; 114/125

(58) Field of Classification Search ..... 114/121, 114/122, 124, 125, 264, 265, 266
See application file for complete search history.

(56) References Cited

U.S. PATENT DOCUMENTS 2,889,795 A * 6/1959 Parks ..... 114/125
4,231,313 A * 11/1980 Heerema et al. ..... 114/265
4,864,958 A * 9/1989 Belinsky ..... 114/265
6,378,451 B1 * 4/2002 Wetch et al. ..... 114/265

* cited by examiner

*Primary Examiner* — Lars A Olson

(57) ABSTRACT

A semi-submersible floating platform for use in offshore applications having a semi-submersible hull structure including motion damping support columns, a pontoon structure adjoined to the motion damping support columns at a lower end thereof, and a deck structure supported at an upper end of thereof for supporting equipment mounted thereon above the water surface. Each motion damping support column has an inner water trapping damper chamber of closed base or open base construction that allows natural flooding of said inner water trapping damper chamber during installation and before reaching an operating draft of the platform, and which when flooded provides hydrodynamic mass, damping, and in-water weight to said platform during operation. A plurality of smaller columns are disposed on the perimeter of the upper portion of each support column and surround the upper portion of the inner water trapping damper chamber.

9 Claims, 6 Drawing Sheets

OFFSHORE FLOATING PLATFORM WITH MOTION DAMPER COLUMNS

CROSS REFERENCE TO RELATED APPLICATION

This application claims priority of U.S. Provisional Application Ser. No. 61/176,903, filed May 9, 2009.

FIELD OF THE INVENTION

This invention relates generally to offshore floating vessels and platform structures and, more particularly, to a semi-submersible floating platform having a semi-submersible hull structure, with one or more deck supporting columns having damper chambers for providing hydrodynamic mass, damping, and in-water weight to the platform during operation.

BACKGROUND ART

Key et al, U.S. Pat. No. 6,701,861 discloses a semi-submersible floating production vessel which has a ring pontoon with three main columns extending upwardly from corners of the pontoon and three secondary, minor columns extending upwardly from centers of the triangular sides. The columns support an open frame deck, on which production modules are positioned. The vessel is adapted for semi-permanent mooring with pre-tensioned mooring lines that are attached to swivel pad eyes secured on the main columns below the water line. Production and export risers are connected to the vessel below the water line. A compressed air ballast system allows selective emptying of ballast compartments located in the ring pontoon and eliminates the need for a conventional pump room.

Huang et al, U.S. Pat. No. 6,503,023 discloses a temporary stability module for marine structures and a method for using the modules during the construction, transportation, installation and/or removal of the structure that permit the structure, including platform, deck and equipment to be constructed in an upright position, towed to an ocean installation site, and installed by ballasting the structure or temporary stability modules and subsequent removal of the modules. The removable temporary stability modules are shown attached to an "extended-base" "tension leg" platform having four uniform rectangular support columns disposed about a central axis of the substructure and horizontal pontoons interconnecting adjacent columns at their lower ends. The substructure also includes leg extensions radiating from the columns and/or the pontoons, which are described more fully in U.S. Pat. No. 6,447,208, discussed below.

Huang et al, U.S. Pat. No. 6,447,208 discloses an "extended-base" "tension leg" substructure, and an offshore platform supported on the substructure and a method for supporting an offshore platform on the substructure. The substructure includes a plurality of support columns disposed about a central axis of the substructure and interconnected by at least one pontoon. Each column comprises an above-water portion and a submerged portion. The substructure also includes a plurality of wings or arms radiating from the columns and/or the pontoons, each wing fixedly or removably securing at least one tendon extending from the wing to an anchor on the seabed. The substructure includes an open, wave transparent, central zone for improved access to well-related equipment, conduits or the like and the wings minimize translational movement and rotational flex in the substructure reducing fatigue in the tendons and their connections.

Frimm et al, U.S. Pat. No. 6,015,245 discloses a ring pontoon semi-submersible offshore vessel wherein the vertical centerline of each of the corner columns is located inward of both the axial centerline of the forward section of the ring pontoon and the axial centerline of the aft section of the ring pontoon. Additionally, the vertical centerlines of the corner columns may be located inward with respect to the axial centerlines of the starboard and port portions of the ring pontoon. The superstructure deck may be supported by radial braces extending from the ring pontoon to locations on the superstructure deck, which are inward of the ring pontoon.

Liden, U.S. Pat. No. 4,498,412 discloses a semi-submersible offshore platform having an operating deck carried by four cylindrical uniform columns supported by a pontoon structure comprising four-sided boxes formed into a square ring. Each pontoon box is subdivided into two compartments by a longitudinal centerline bulkhead, the compartments being further subdivided into tanks by transverse bulkheads. Tanks outside the centerline bulkheads are used for ballast water, and tanks inside the centerline bulkheads are used to store the oil produced.

Ludwigson, U.S. published patent application 20010026733, published Oct. 4, 2001, discloses a semi-submersible vessel adapted to resist heave motion that includes a plurality of support columns with a square-shaped ring pontoon connected to their lower ends. The axial centerline of the square-shaped ring pontoon intersects the axial centerline of the lower ends of the support columns, and the support columns are inclined upwardly and inwardly from the ring pontoon to the deck.

Wybro et al, U.S. Pat. No. 7,140,317 discloses a central ring pontoon semi-submersible floating platform for use in offshore applications having a hull configuration including vertical support columns, a central pontoon structure disposed inboard of the columns at a lower end thereof, and a deck structure supported at an upper end of the columns. The vertical columns and pontoon structure are constructed substantially of flat plate. The vertical columns are adjoined to the outer periphery of the central pontoon and have a transverse cross sectional shape with a major axis oriented radially outward from a center point of the hull, and a central vertical axis disposed a distance outward from the pontoon outer periphery. Risers can be supported on the inboard or outboard side of the pontoon and extended to the deck, and the structure can be anchored by mooring lines extending along the outboard face of the columns extending radially outward and downward from their lower ends.

Horton, U.S. Pat. No. 6,935,810 discloses a semi-submersible, multicolumn deep draft floating offshore oil and gas oil and production platform comprising a floating hull having an adjustably buoyant base, a plurality of columns vertically upstanding from the base and an equipment deck that is supported atop the columns when the platform is operationally deployed. Each of the columns comprises a cellular structure that includes a plurality of elongated tubes having a variety of cross-sectional shapes extending from the base to the top of the column. Each of the tubes defines one or more closed compartments. At least one of the compartments has buoyancy that is adjustable. The buoyancy of the compartments and the base can be controllably adjusted with pressurized air to provide a safer and less costly method for deploying the platform for offshore operations.

Haselton, U.S. Pat. No. 3,986,471 discloses apparatus for damping vertical movement of a semi-submersible vessel having a small water plan area, whose buoyancy is provided substantially completely by submerged pontoon means and which includes at least one submerged damper plate supported deep beneath the vessel by flexible tensioned support elements, such as chains or cables and which has valves or similar flow controllers therein for providing substantially greater resistance to the upward movement of the plate than the downward movement. The area of the damper plate is several times larger than the water plane area of the vessel and provides low resistance to downward movement and higher resistance to upward movement.

Xu et. al, U.S. Pat. No. 6,652,192 discloses an apparatus for a heave suppressed floating offshore drilling and production platform having vertical columns, lateral trusses connecting adjacent columns, a deep submerged horizontal plate supported from the bottom of the columns by vertical truss legs and a topside deck supported by the columns. During the launch of the platform and towing in relatively shallow water the truss legs are stowed in shafts within each column and the plate is carried just below the lower end of the columns. After the platform has been floated to the deepwater site, the truss legs are lowered from the column shafts to lower the plate to deep draft for reducing the effect of wave forces and to provide heave and vertical motion resistance to the platform.

Wetch, U.S. Pat. No. 6,666,624 discloses a floating platform comprising an uppermost buoyant and ballastable hull partially submerged in water without contacting the floor of the body of water and usually without being moored to the floor of the body of water. The bottom of the uppermost hull is attached to the top of a lower buoyant and ballastable hull after the lower hull has been completely submerged and anchored to the floor of the body of water with flexible mooring.

Srinivasan, U.S. Pat. No. 6,761,124 discloses column stabilized floating structures having a deck and a plurality of vertical buoyant caissons bridged together in distantly spaced relation by plurality of open frame horizontal truss pontoon members and a vertical truss column at the lower end. The buoyancy of the caissons is selectively adjusted by means of ballast control. Water is selectively pumped into and out of the keel tanks at the bottom of the truss structure to raise or lower the center of gravity of the entire mass of the floating structure relative to the center of buoyancy to compensate for different operational, environmental and survival conditions.

Mougin, U.S. Pat. No. 4,241,685 discloses a self-stabilizing offshore floating tower comprising two coaxial cylindrical enclosures interconnected by continuous radial bulkheads forming, in the upper portion, a ring of damping chambers and, in the lower portion, a ring of buoyancy tanks around a bell-shaped chamber which is partially filled with air to produce pneumatic damping of vertical movement of the tower. The upper portion of the tower is separated from the lower portion by a horizontal slab, and the upper portion of the internal enclosure is perforated in the vicinity of the horizontal slab.

Horton U.S. Pat. No. 6,817,309 discloses a floating hull for a single-column spar-type offshore oil and gas drilling and production platform which comprises a plurality of parallel tubular cells that are subdivided into compartments having a buoyancy controlled by one or both of fixed and variable ballast. The cells include side wall openings for admitting and discharging seawater and petroleum ballast with pumps. Fixed and/or variable ballast may be disposed on or in the cells to adjust buoyancy, trim, and stability. Lower and upper portions of the cells may extend above or below the others for trim or stability. Longitudinal recesses may be formed in an exterior peripheral surface for routing of mooring lines and piping. Stepped helical strakes can be disposed on an outer peripheral surface of the platform or some of the cells to reduce vortex-induced vibrations of the platform.

SUMMARY OF THE INVENTION

The present invention is distinguished over the prior art in general, and these patents in particular, by an offshore floating platform for use in offshore applications, such as for offshore oil and gas drilling and production, that has a semi-submersible hull structure including vertical or battered support columns with motion damping chambers, a pontoon structure adjoined to the lower ends thereof, and a deck structure supported at an upper end of the columns for supporting the deck and equipment mounted thereon above the water surface. The motion damping support columns may be of variable cross sectional area along their length and include naturally flooded inner damper chamber(s) of closed base or open base construction which, when flooded, trap and retain significant seawater mass during operation to provide significant system motion damping compared to conventional semi-submersible structures having uniform columns without damper chambers. The exterior configuration of the support columns with inner water trapping damper chambers include an upper portion and a lower portion. The lower portion surrounds the lower portion of the inner water trapping damper chamber and has a solid side wall which does not allowing flooding of the inner chamber during quayside integration and wet-tow of the platform. This provides significant water plane area and platform stability during deck/hull quayside integration and wet-tow. The upper portion of the support column(s) include a group of columns of relatively smaller cross sectional area arranged on the perimeter of the support columns and supported on the lower portion to surround the upper portion of the inner water trapping damper chamber. The upper portion of the support columns are configured to allow natural flooding of the inner chambers during installation at a draft deeper than the wet-tow draft. The support columns with motion damping chambers provide hydrodynamic mass, damping, and in-water weight to the platform during operation.

DESCRIPTION OF THE PREFERRED EMBODIMENTS

Figure 1:
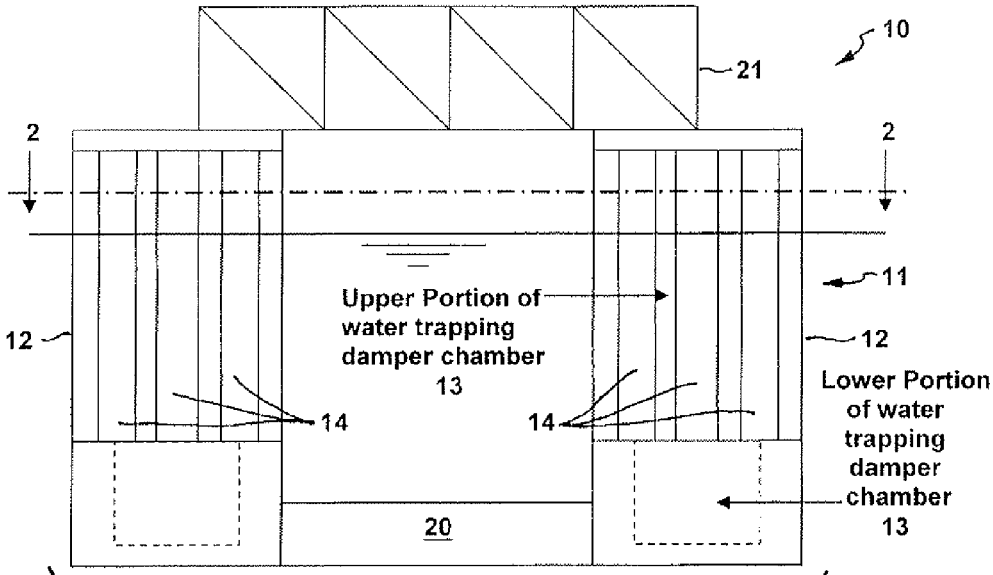
FIG. 1 is a side elevation view showing, somewhat schematically, a semi-submersible floating platform with cylindrical motion damping support columns having an inner water trapping damper chamber and a group of columns of relatively smaller cross sectional area arranged on the perimeter of the support columns in accordance with a first embodiment of the present invention.
Figure 2:
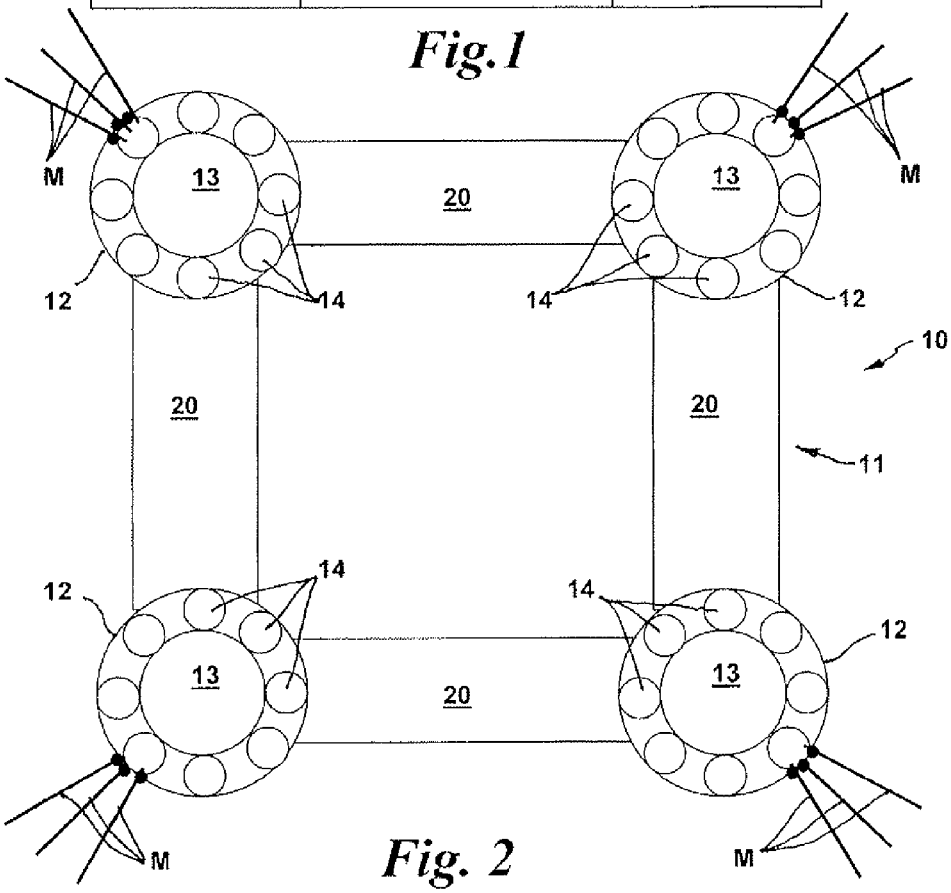
FIG. 2 is a transverse cross sectional view of the platform taken along lines 2-2 of FIG. 1, showing the inner water trapping column and arrangement of columns of relatively smaller cross sectional area on the perimeter thereof.

Referring to the drawings by numerals of reference, there is shown somewhat schematically in FIGS. 1 and 2, a semi-submersible floating platform 10 in accordance with a first multi-column embodiment of the present invention for use in offshore applications, such as for offshore oil and gas drilling and production. The platform 10 has a hull 11 including motion damping support columns 12, a generally rectangular ring-shaped pontoon structure 20 disposed between the support columns at a lower end thereof, and a deck structure 21 supported at the upper ends of the support columns for supporting drilling and production equipment, or other facilities for the particular application, mounted thereon above the water surface.

In this embodiment, the motion damping support columns 12 are generally cylindrical columns having an inner damper chamber 13 of closed base or open base construction which, when flooded, can trap and retain significant seawater mass during operation to provide significant system motion damping compared to conventional semi-submersible structures having uniform columns without damper chambers. The motion damping support columns 12 have an upper portion of smaller diameter and a lower portion of larger diameter defining a stepped configuration surrounding the inner damper chamber 13.

The lower portion of each support column 12 surrounds the lower portion of the inner water trapping damper chamber 13 and has a solid side wall which does not allowing flooding of the inner chamber during quayside integration and wet-tow of the platform. This provides significant water plane area and platform stability during deck/hull quayside integration and wet-tow.

A plurality of smaller cylindrical columns 14 of relatively smaller cross sectional area are disposed on the perimeter of each support columns in circumferentially spaced relation and supported at a bottom end on the top end of the larger diameter lower portion to surround the upper portion of the inner water trapping damper chamber 13.

The upper portion of the support columns 12 are configured to allow natural flooding of the inner chambers 13 during installation at a draft deeper than the wet-tow draft. For example, the upper portion of the support columns 12 may be provided with one or more openings to allow natural water flooding of the inner water trapper damper chamber above a certain level from the base of the support column. The support columns 12 with motion damping chambers provide hydrodynamic mass, damping, and in-water weight to the platform during operation.

In the illustrated example, the pontoon structure 20 is shown as a generally rectangular ring-pontoon structure with box-shaped sides of generally rectangular transverse cross section surrounding a central opening, for purposes of example only, and is not limited thereto. It should be understood that various other types of pontoon structures may be utilized; for example, truss pontoons attached at the base of each support column with horizontal trusses connecting each pair of adjacent pontoons.

The central longitudinal axis or centerline of each support column 12 may be oriented perpendicular to and intersect the axial horizontal centerline of the pontoon structure 20 adjoined at the lower end of the support columns and extend upwardly therefrom in a generally vertical orientation, or, the columns may be battered or inclined angularly inward toward the central longitudinal axis of the hull.

The platform structure 10 may be anchored by a plurality of mooring lines M extending through fairleads mounted on the lower end of the outboard side wall of the support columns 12 with the upper ends of the lines extending generally parallel upwardly along the outboard sidewall to mooring winches on the deck or upper ends of the columns and their lower ends extending radially outward and downward from the fairleads and anchored to the sea bed. With the present mooring system, the mooring loads do not cause substantial restraint against the vertical and rotational motions of the platform and the damper weight member provides improved rotational stability with changes in the direction of wind, wave and currents.

It should be understood that the platform structure 10 may also be a vertically moored floating structure or "tension leg" platform which is moored by means of tethers or tendons grouped at each of the structure's corners and anchored to the ocean floor.

Figure 3:
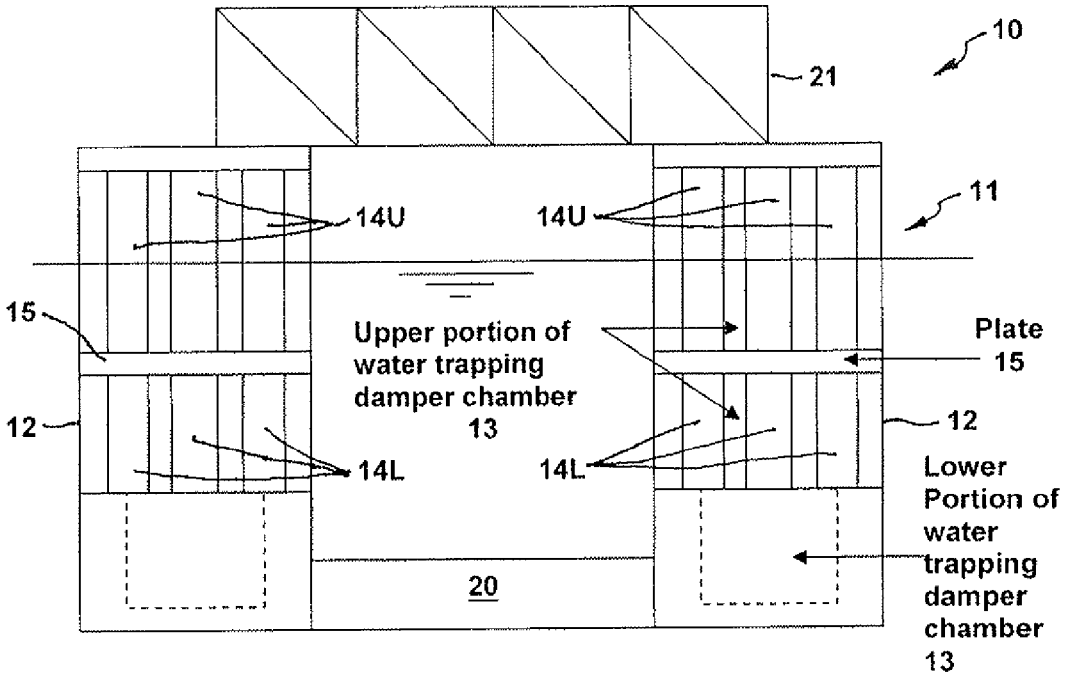
FIG. 3 is a side elevation view showing, somewhat schematically, a modification of the semi-submersible floating platform of FIG. 1, wherein the upper portion of the cylindrical motion damping support columns and smaller peripheral columns and divided along their length by a generally horizontal plate.

FIG. 3 is a side elevation view showing, somewhat schematically, a modification of the semi-submersible floating platform 10 of FIG. 1, wherein the upper portion of each motion damping support column 12 and smaller peripheral columns 14 are divided along their length into upper and lower segments 14U and 14L by a generally horizontal plate 15.

Figure 4:
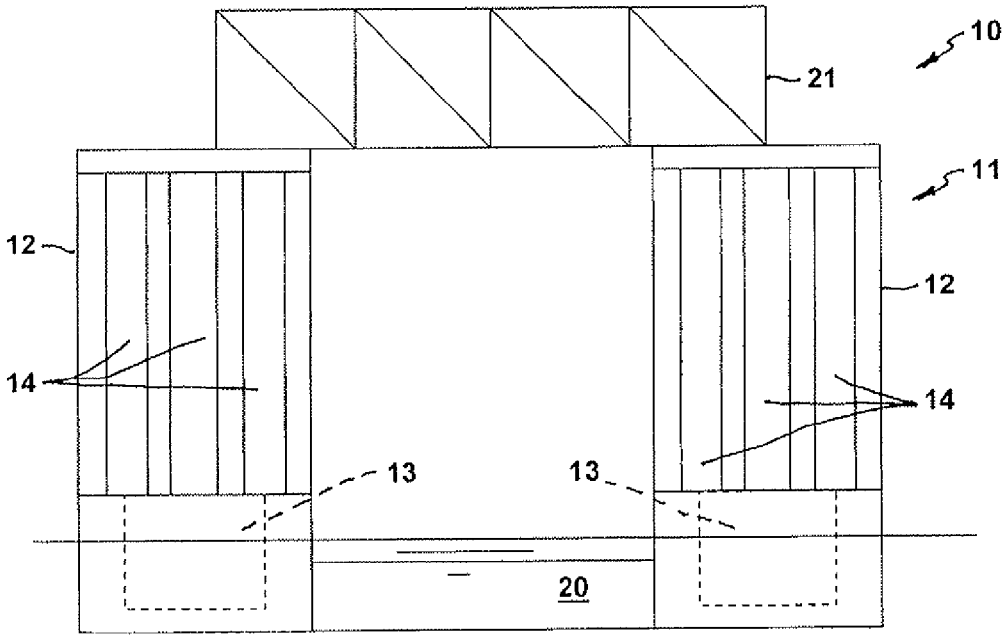
FIG. 4 is a side elevation view showing, somewhat schematically, the semi-submersible floating platform of FIG. 1 in a transit condition wherein the inlet of the cylindrical inner water trapping damper chamber is closed.

FIG. 4 is a side elevation view showing, somewhat schematically, the semi-submersible floating platform 10 of FIG. 1 wherein the inner water trapping damper chamber 13 is not flooded and the platform is in a wet-tow transit condition.

Figure 5:
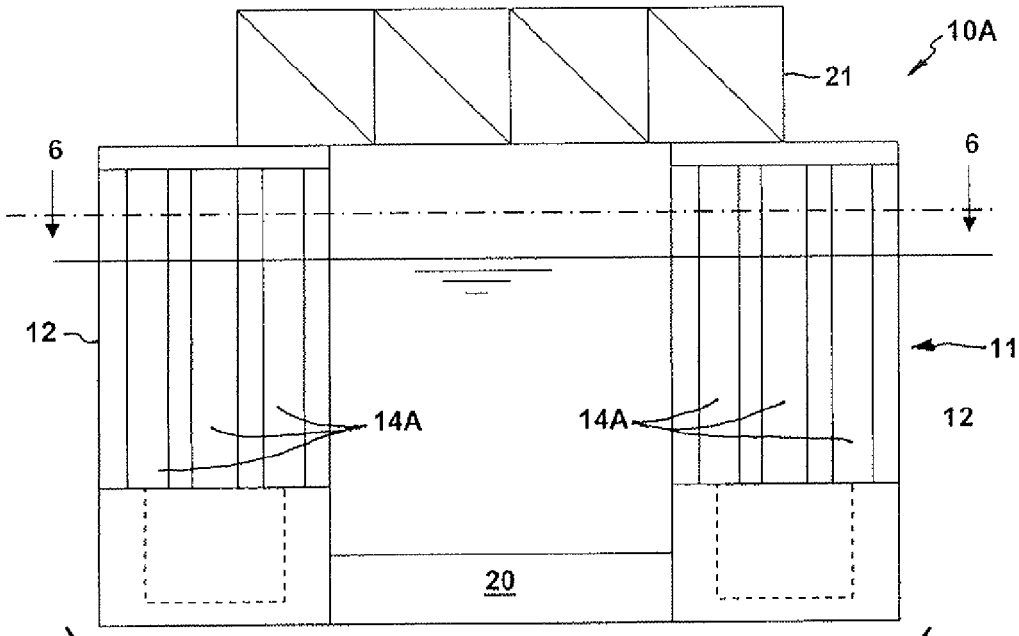
FIGS. 5 and 6 are a side elevation view and a transverse cross sectional view, respectively, showing somewhat schematically, a semi-submersible floating platform with cylindrical motion damping support columns having a cylindrical inner water trapping damper chamber and a group of generally pie-shaped columns arranged on the perimeter of the support columns in accordance with a second embodiment of the present invention.
Figure 6:
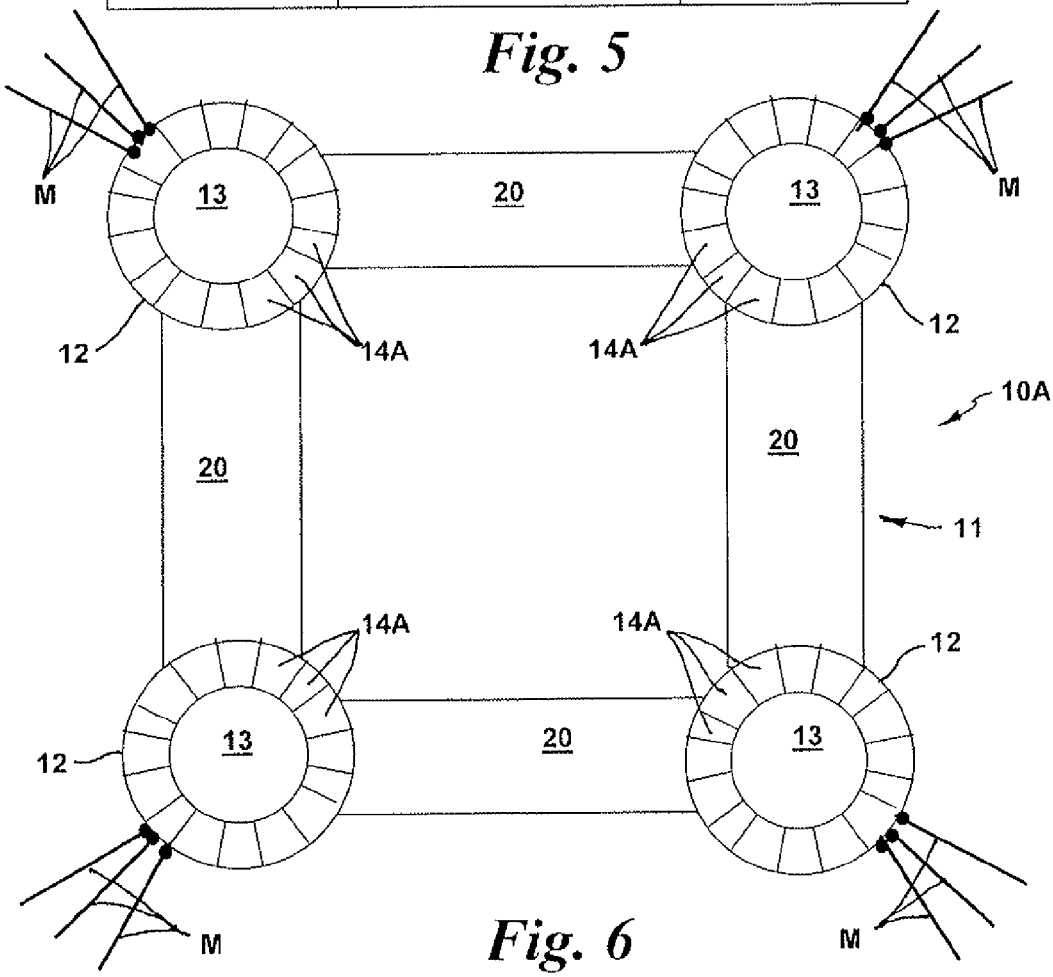

Referring now to FIGS. 5 and 6, there is shown, somewhat schematically, a second embodiment of the semi-submersible floating platform 10A with cylindrical motion damping support columns 14 having a cylindrical inner water trapping damper chamber 13 and a plurality of generally wedge-shaped columns or chambers arranged on the perimeter of the support columns in circumferentially adjacent relation. The components that are the same as described above in the previous embodiment are assigned the same numerals of reference, but will not be described again in detail to avoid repetition.

Figure 7:
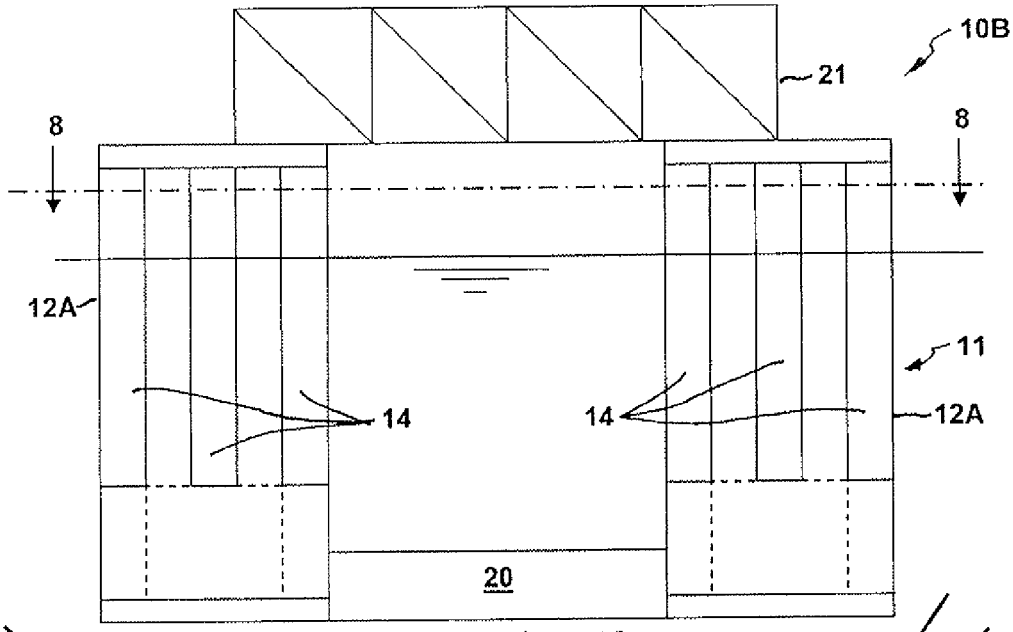
FIGS. 7 and 8 are a side elevation view and a transverse cross sectional view, respectively, showing somewhat schematically, a semi-submersible floating platform with generally rectangular motion damping support columns having a generally rectangular inner water trapping damper chamber and a group of smaller cylindrical columns arranged on the perimeter of the support columns in accordance with a third embodiment of the present invention.
Figure 8:
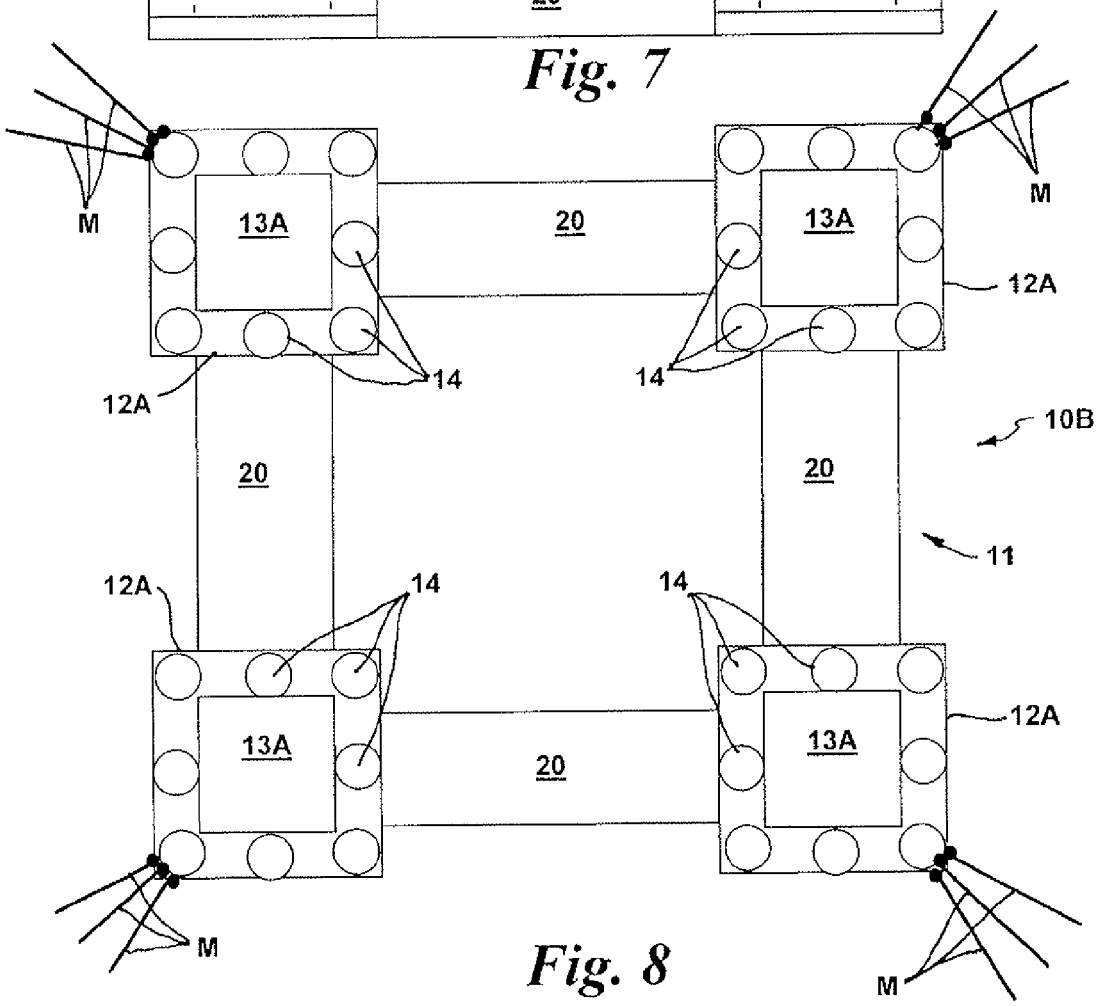

FIGS. 7 and 8 show, somewhat schematically, a third embodiment of the semi-submersible floating platform 10B having generally rectangular motion damping support columns 12A and a generally rectangular inner water trapping damper chamber 13A. In this embodiment, a plurality of smaller cylindrical columns 14 are disposed on the perimeter of the generally rectangular support columns 12A in adjacent spaced apart relation. The components that are the same as described above in the previous embodiments are assigned the same numerals of reference, but will not be described again in detail to avoid repetition.

Figure 9:
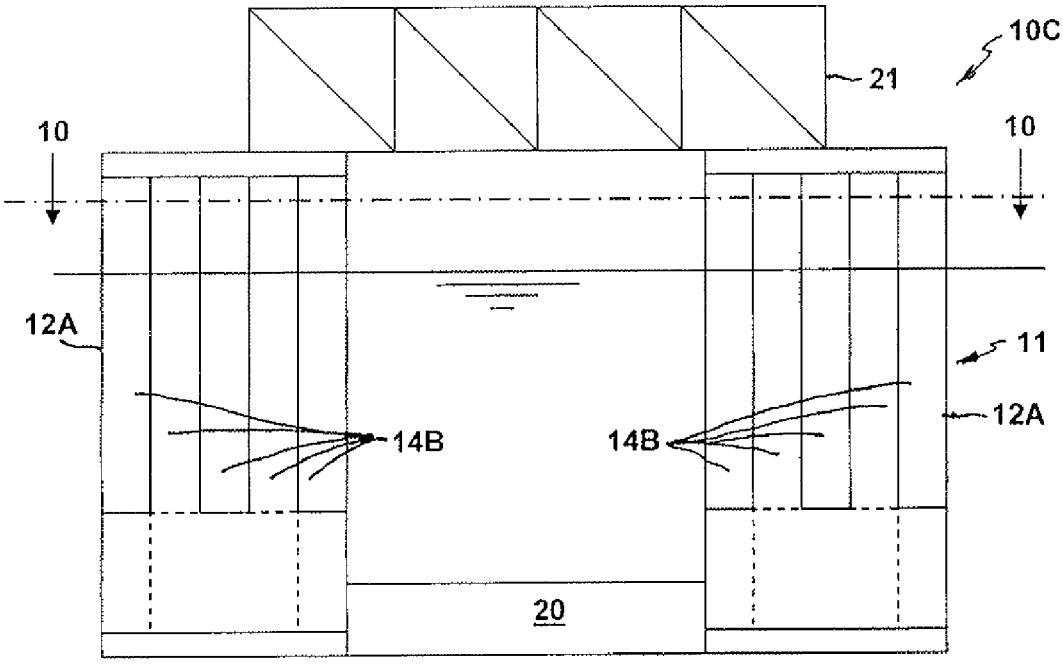
FIGS. 9 and 10 are a side elevation view and a transverse cross sectional view, respectively, showing somewhat schematically, a semi-submersible floating platform with generally rectangular motion clamping support columns having a generally rectangular inner water trapping damper chamber and a group of smaller generally rectangular columns arranged on the perimeter of the support columns in accordance with a fourth embodiment of the present invention.
Figure 10:
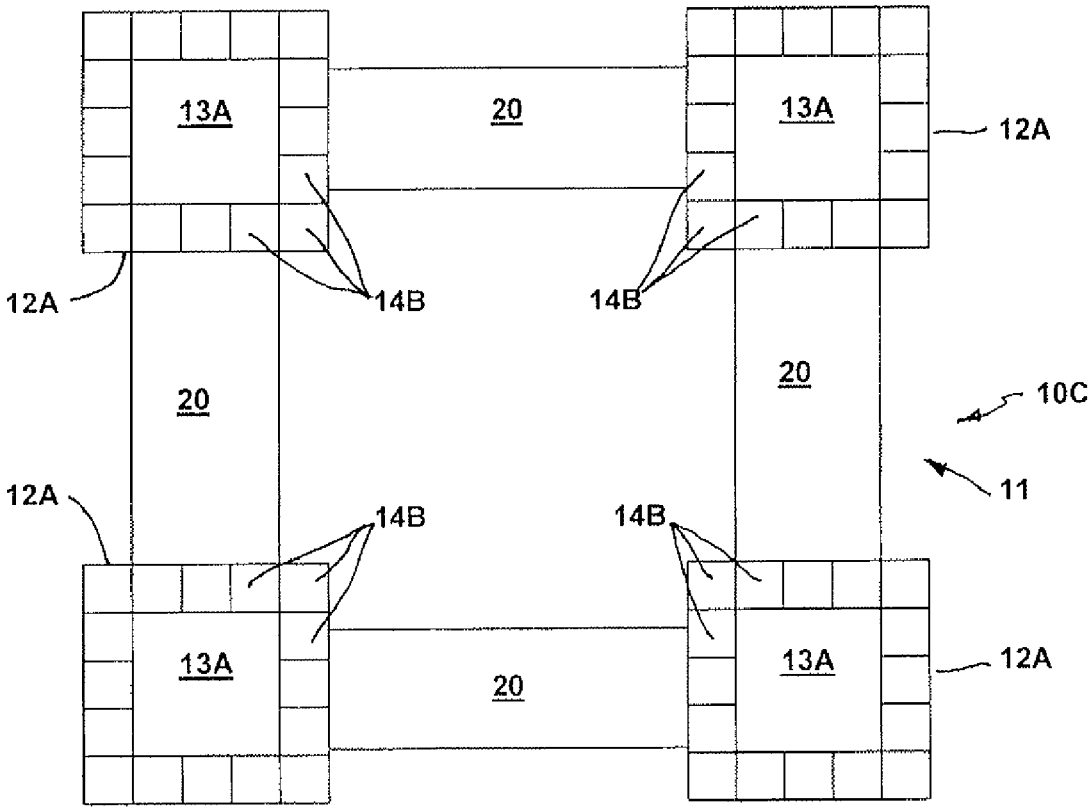

FIGS. 9 and 10 show, somewhat schematically, a fourth embodiment of the semi-submersible floating platform 10C having generally rectangular motion damping support columns 12A, each having a generally rectangular inner water trapping damper chamber 13A. In this embodiment, a plurality of smaller generally rectangular columns 14B disposed on the perimeter of the generally rectangular support columns 12A in adjacent relation. The components that are the same as described above in the previous embodiments are assigned the same numerals of reference, but will not be described again in detail to avoid repetition.

Figure 11:
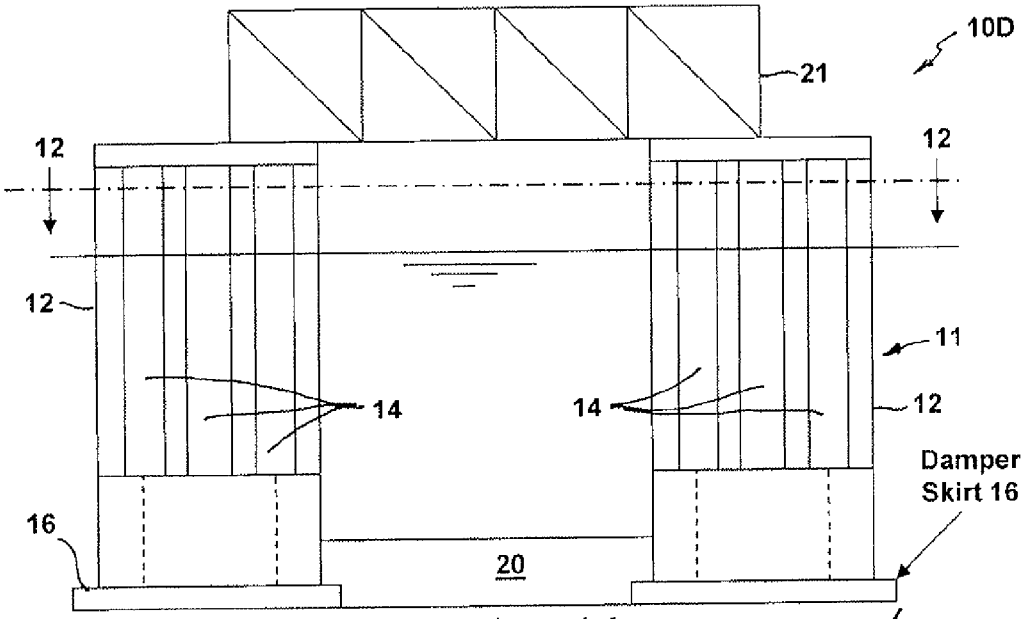
FIGS. 11 and 12 are a side elevation view and a transverse cross sectional view, respectively, showing somewhat schematically, a semi-submersible floating platform with cylindrical motion damping support columns having a cylindrical inner water trapping damper chamber and a group of smaller cylindrical columns on the perimeter of the support columns, and having a damper skirt at the base of the support columns in accordance with a fifth embodiment of the present invention.
Figure 12:
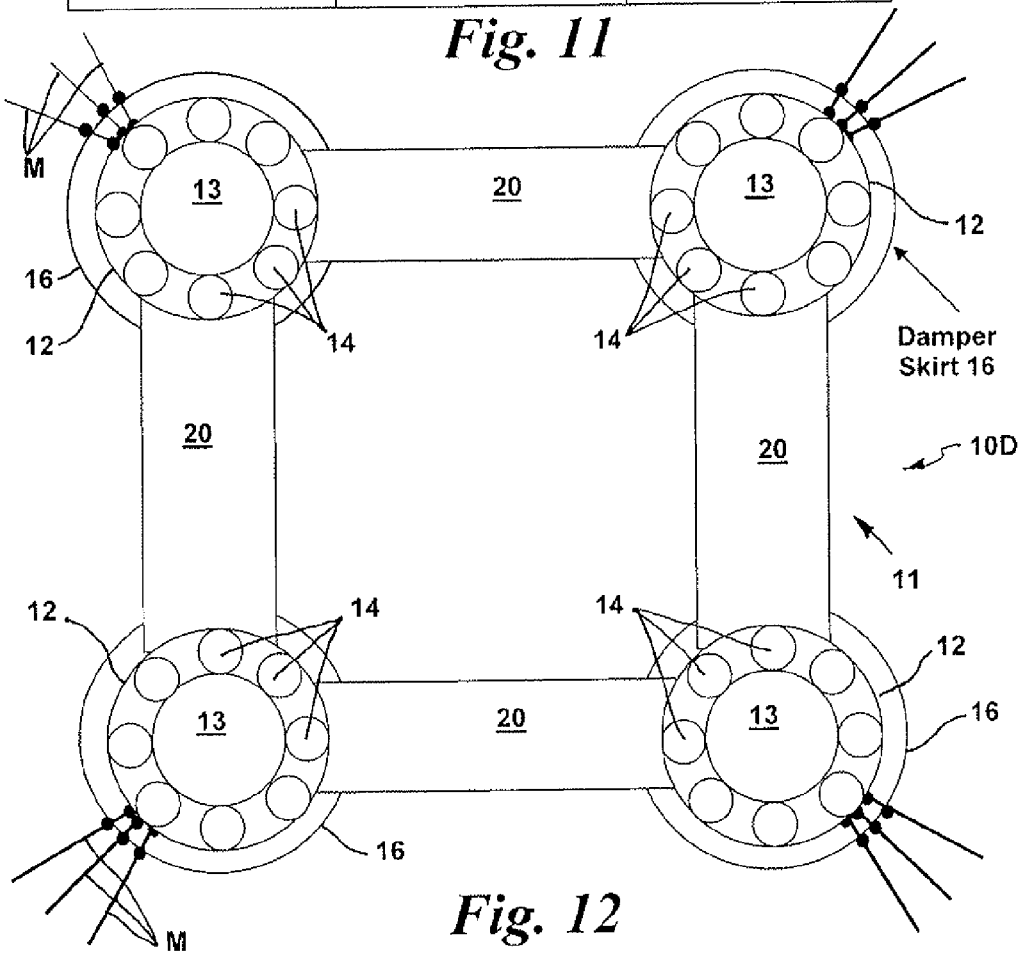

Referring now to FIGS. 11 and 12, there is shown, somewhat schematically, a fifth embodiment of the semi-submersible floating platform 10D with cylindrical motion damping support columns 12, each having a cylindrical inner water trapping damper chamber 13 and a plurality of smaller cylindrical columns 14 on the perimeter of the support column. In this embodiment, a damper skirt 16 is disposed at the base of each of the support columns 12. The damper skirt 16 extends radially outward from the larger diameter lower portion of each motion damping support column 12 and provides additional motion damping and hydrodynamic mass to the platform during operation.

Although the motion damping support columns in the exemplary embodiments have been shown and described as being generally cylindrical or rectangular, it should be understood that the motion damping support columns, and the smaller peripheral columns may be provided in other configurations, such as a quadrilateral transverse cross section or trapezoidal shaped configurations.

It should also be understood that the interior the motion damping columns, the peripheral columns, and the pontoon structure may be subdivided by bulkheads to strengthen the structures, to provide enclosed spaces for locating and storing various equipment (e.g., anchors, chains, propulsion mechanisms, etc.), and to provide a plurality of separate compartments for purposes of ballasting the platform and storing various fluids and other materials which may be required or desired during drilling or production by the well. One or more of the interior compartments may be used for storage of petroleum products so as to enable the platform as a floating production storage and offloading facility (FPSO). Conventional ballast control means, pumps and piping systems are provided for selectively pumping water into and out of the compartments of the columns and pontoon structure to adjust the weight and ballast. Such ballast control means, pumps and piping systems are conventional and well known in general shipboard and submarine ballast design practice, and therefore not shown or described in detail.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A semi-submersible floating platform for use in offshore applications, comprising:

a semi-submersible hull structure including motion damping support columns, a pontoon structure adjoined to said motion damping support columns at a lower end thereof, and a deck structure supported at an upper end of said motion damping support columns for supporting equipment mounted thereon above the water surface;

each of said motion damping support columns having an inner water trapping damper chamber of closed base or open base construction that allows natural flooding of said inner water trapping damper chamber during installation and before reaching an operating draft of said platform, and which when flooded provides hydrodynamic mass, damping, and in-water weight to said platform during operation;

each said motion damping support column having an upper portion of smaller transverse cross sectional area, and a lower portion of larger transverse cross sectional area defining a stepped exterior configuration surrounding said inner water trapping damper chamber; and a plurality of smaller columns each having a cross sectional area smaller than said larger transverse cross sectional area of said support column upper portion disposed on the perimeter of each support column upper portion in adjacent relation and supported at a bottom end on a top end of said lower portion to surround said upper portion of said inner water trapping damper chamber.

2. The semi-submersible floating platform according to claim 1, wherein said pontoon structure is adjoined to said lower ends of said support columns to define a generally ring-shaped pontoon structure; and said support columns extend upwardly from said pontoon structure in either of a vertical orientation generally parallel with a central longitudinal axis of said hull or a battered orientation inclined angularly inwardly toward the central longitudinal axis of the hull structure.

3. The semi-submersible floating platform according to claim 1, further comprising:

station keeping means connected with said motion damping support columns for maintaining said platform above a subsea location.

4. The semi-submersible floating platform according to claim 1, wherein said lower portion of each support column has a solid side wall which does not allow flooding of said inner water trapping damper chamber during quayside integration and wet-tow of the platform, and said upper portion of each support column has at least one opening to allow natural water flooding of said inner water trapping damper chamber above a certain level from the base of said support column.

5. The semi-submersible floating platform according to claim 1, further comprising:

a damper skirt disposed at the base of each said motion damping support column extending radially outward from said lower portion of said motion damping support column to provide additional motion damping and hydrodynamic mass to said platform during operation.

6. The semi-submersible floating platform according to claim 1, wherein each of said motion damping support columns is a generally cylindrical column having an upper portion of smaller diameter and a lower portion of larger diameter defining said stepped exterior configuration, and said plurality of smaller columns comprise cylindrical columns having a diameter smaller than said larger diameter of said support column upper portion disposed on the perimeter of each said support column upper portion in adjacent circumferentially spaced relation.

7. The semi-submersible floating platform according to claim 1, wherein each of said motion damping support columns is a generally cylindrical column having an upper portion of smaller diameter and a lower portion of larger diameter defining said stepped exterior configuration, and said plurality of smaller columns comprise a plurality of generally wedge-shaped columns or chambers disposed on the perimeter of each said support column in circumferentially adjacent relation.

8. The semi-submersible floating platform according to claim 1, wherein each of said motion damping support columns is a generally rectangular column having an upper portion of smaller transverse cross sectional area and a lower portion of larger transverse cross sectional area defining said stepped exterior configuration, and said plurality of smaller columns comprise a plurality of cylindrical columns having a diameter smaller than said larger transverse cross sectional area of said support column upper portion disposed on the perimeter of each said support column upper portion in adjacent spaced apart relation.

9. The semi-submersible floating platform according to claim 1, wherein each of said motion damping support columns is a generally rectangular column having an upper portion of smaller transverse cross sectional area and a lower portion of larger transverse cross sectional area defining said stepped exterior configuration, and said plurality of smaller columns comprise a plurality of smaller generally rectangular columns disposed on the perimeter of each said support column in adjacent relation.

* * * * *